US010008796B1

(12) United States Patent
Wang et al.

(10) Patent No.: US 10,008,796 B1
(45) Date of Patent: Jun. 26, 2018

(54) CONNECTOR STRUCTURE

(71) Applicant: P-TWO INDUSTRIES INC., Taoyuan (TW)

(72) Inventors: Chien-Chun Wang, Taoyuan (TW); Chih-Ping Chung, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days. days.

(21) Appl. No.: 15/710,845

(22) Filed: Sep. 21, 2017

(30) Foreign Application Priority Data

Dec. 16, 2016 (TW) ..... 105141817 A

(51) Int. Cl.

| | |
|---|---|
| ***H01R 13/648*** | (2006.01) |
| ***H01R 12/72*** | (2011.01) |
| ***H01R 13/6582*** | (2011.01) |
| ***H01R 13/405*** | (2006.01) |
| ***H01R 13/627*** | (2006.01) |

(52) U.S. Cl.
CPC ..... *H01R 12/721* (2013.01); *H01R 13/405* (2013.01); *H01R 13/6275* (2013.01); *H01R 13/6582* (2013.01)

(58) Field of Classification Search
CPC ..... H01R 13/6587; H01R 23/668
USPC ..... 439/607.11, 607.05
See application file for complete search history.

(56) References Cited

U.S. PATENT DOCUMENTS

| | | | | |
|---|---|---|---|---|
| 9,478,923 | B2 * | 10/2016 | Kao | H01R 24/60 |
| 9,673,569 | B2 * | 6/2017 | Zhang | H01R 13/6585 |
| 9,859,661 | B2 * | 1/2018 | Park | H01R 13/6585 |
| 2017/0110821 | A1 | 4/2017 | Oyake | |

FOREIGN PATENT DOCUMENTS

| | | |
|---|---|---|
| TW | I525942 | 3/2016 |

* cited by examiner

*Primary Examiner* — Phuong Dinh
(74) *Attorney, Agent, or Firm* — Winston Hsu

(57) ABSTRACT

A connector structure includes an upper connecting component, a lower connecting component, a shielding plate, a metal housing, an upper insulating component, an upper grounding component, a lower insulating component and a lower grounding component. The upper/lower connecting component includes an upper/lower main body and a plurality of upper/lower terminals. The shielding plate is disposed between the upper connecting component and the lower connecting component. The metal housing covers the upper main body, the shielding plate and the lower main body and covers the plurality of upper/lower terminals to form a docking space. A docking opening is formed on a side of the docking space, and the metal housing includes a stopping portion disposed around the docking opening. The upper/lower insulating component is disposed in the docking space and restrained between the stopping portion and the upper/lower main body. The upper/lower grounding component is disposed on the upper/lower insulating component.

16 Claims, 8 Drawing Sheets

CONNECTOR STRUCTURE

BACKGROUND OF THE INVENTION

1. Field of the Invention

The present invention relates to a connector structure, and more particularly, to a connector structure with easy assembly and low manufacturing cost.

2. Description of the Prior Art

With rapid development of electronic industries and multimedia application, data transmission between electrical appliances is increasing gradually. Besides expanding transmission bandwidth, the current trend is towards to utilize electrical connectors with high frequency signal transmission. The need for standardization in computer related interfaces, as well as the need for high-speed communication interfaces, leads to the development of the universal serial bus (USB) interface. More recently, the USB Type-C connector has emerged as a USB-type connector having a relatively compact size, ultrahigh data transmission speed, and being configured so that the USB Type-C connector can be coupled without regard to plug orientation and/or cable direction, for extensive applications on different electronic devices. Furthermore, because super speed signal terminals of the USB type-C connector, when operating, other electronic components might be interfered by the electromagnetic waves, electromagnetic interference (EMI) proof function is necessary and usually achieved by grounding.

For example, Taiwan Patent no. 1525942 discloses a USB Type-C connector structure mateable with a mating connector along a mating direction. A connector includes a first arrangement member, a second arrangement member, a plurality of first contacts, a plurality of second contacts, a ground member and a holding member. The holding member holds the first arrangement member, the second arrangement member and the ground member to locate the ground member between the first arrangement member and the second arrangement member, which reduces manufacturing cost and is capable of adjusting relative positions of contacts and the ground member. However, there are still some disadvantages of the above-mentioned connector structure. For example, the holding member needs to hold the first arrangement member, the second arrangement member and the ground member, which results in a long length of the holding member, so as to reduce the assembly yield and increase manufacturing cost during the assembly process of the holding member with the first arrangement member, the second arrangement member and the ground member. Besides, a protecting member disposed on a docking opening of the conventional connector is an independent insulating member, and it needs an additional mold production to manufacture the protecting member and also needs an additional assembly process to install the protecting member on the conventional connector, which also increases the manufacturing cost.

SUMMARY OF THE INVENTION

Therefore, an objective of the present invention is to provide a connector structure with easy assembly and low manufacturing cost, for solving the aforementioned problems of low assembly yield and high manufacturing cost of a conventional connector with a long holding member and an independent front protecting member.

In order to achieve the aforementioned objective, the present invention discloses a connector structure including an upper connecting component, a lower connecting component, a shielding plate, a metal housing, an upper insulating component, an upper grounding component, a lower insulating component and a lower grounding component. The upper connecting component includes an upper main body and a plurality of upper terminals disposed on and extending out of the upper main body. The lower connecting component includes a lower main body and a plurality of lower terminals disposed on and extending out of the lower main body. The upper connecting component and the lower connecting component are disposed opposite to each other. The shielding plate is disposed between the upper connecting component and the lower connecting component, and the upper main body and the lower main body are disposed on an upper side and a lower side of the shielding plate respectively. The metal housing covers the upper main body, the shielding plate and the lower main body, and the metal housing further covers around the plurality of upper terminals and the plurality of lower terminals to form a docking space. A docking opening is formed on a side of the docking space, and the metal housing includes a stopping portion disposed around the docking opening. The upper insulating component is disposed in the docking space and restrained between the stopping portion and the upper main body. The upper grounding component is disposed on the upper insulating component. The lower insulating component is disposed in the docking space and restrained between the stopping portion and the lower main body, and the upper insulating component and the lower insulating component are disposed opposite to each other. A channel is formed between the upper insulating component and the lower insulating component, the channel is communicated with the docking opening, and the plurality of upper terminals and the plurality of lower terminals extend into the channel. The lower grounding component is disposed on the lower insulating component.

The connector structure of the present invention utilizes the upper insulating component and the lower insulating component to replace a conventional holding member and further utilizes the stopping portion of the metal housing to replace a conventional protecting member, so as to increase the assembly yield and reduce components of the connector structure. It can effectively solve problems of low assembly yield and high manufacturing cost of the conventional connector, so as to meet requirements of low cost.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate technical specifications and structural features as well as achieved purposes and effects of the present invention, relevant embodiments and figures are described as follows.

Figure 1:
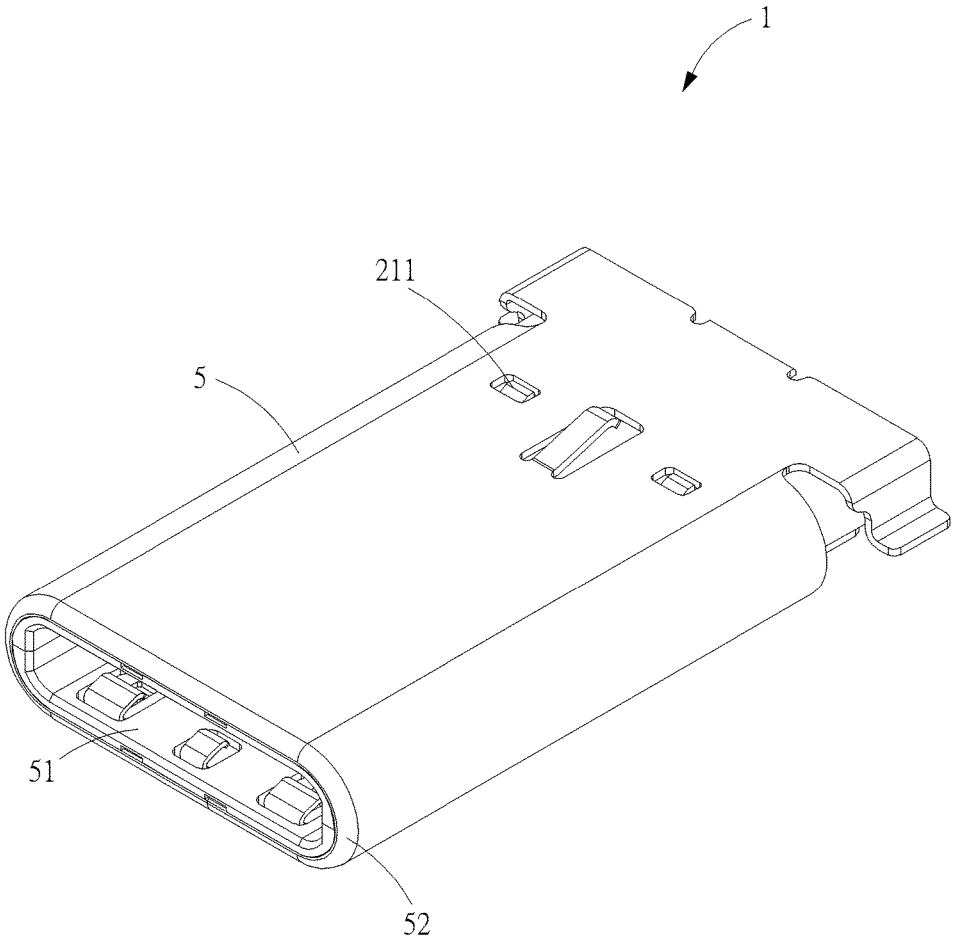
FIG. 1 is a schematic diagram of a connector structure according to an embodiment of the present invention.
Figure 2:
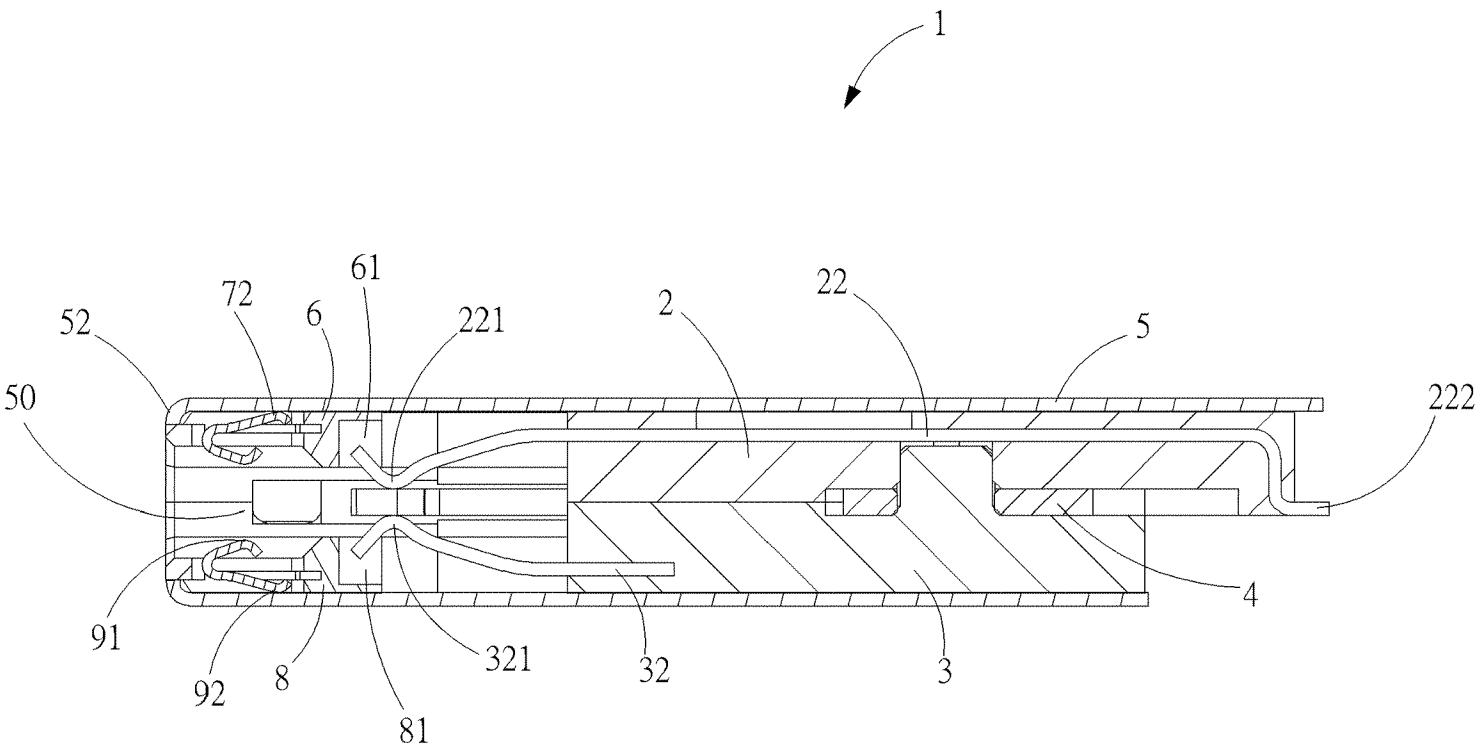
FIG. 2 is a sectional diagram of the connector structure according to the embodiment of the present invention.
Figure 3:
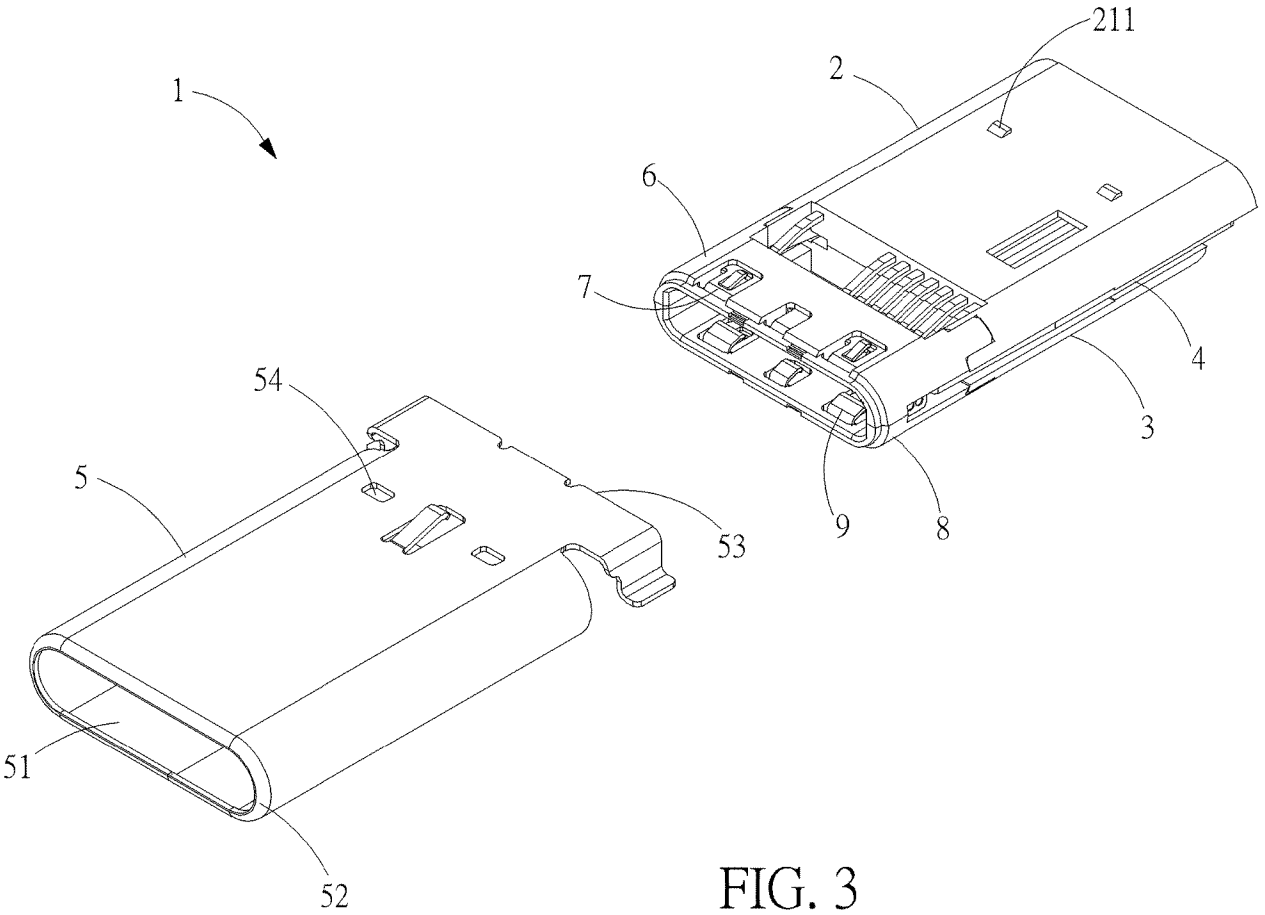
FIG. 3 is a schematic diagram of the connector structure with a disassembled metal housing according to the embodiment of the present invention.
Figure 4:
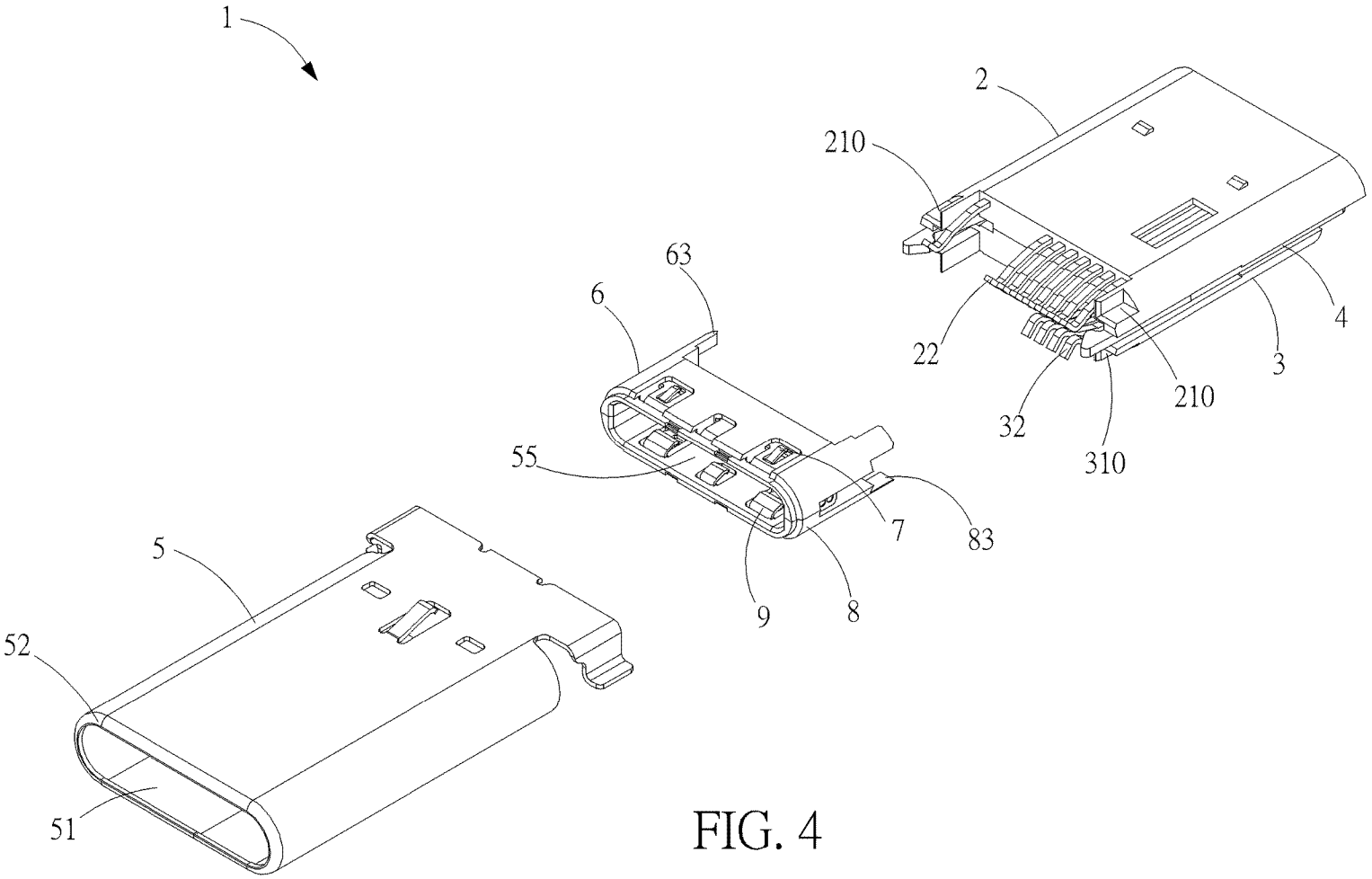
FIG. 4 is a partial exploded diagram of the connector structure as shown in FIG. 1 according to the embodiment of the present invention.
Figure 5:
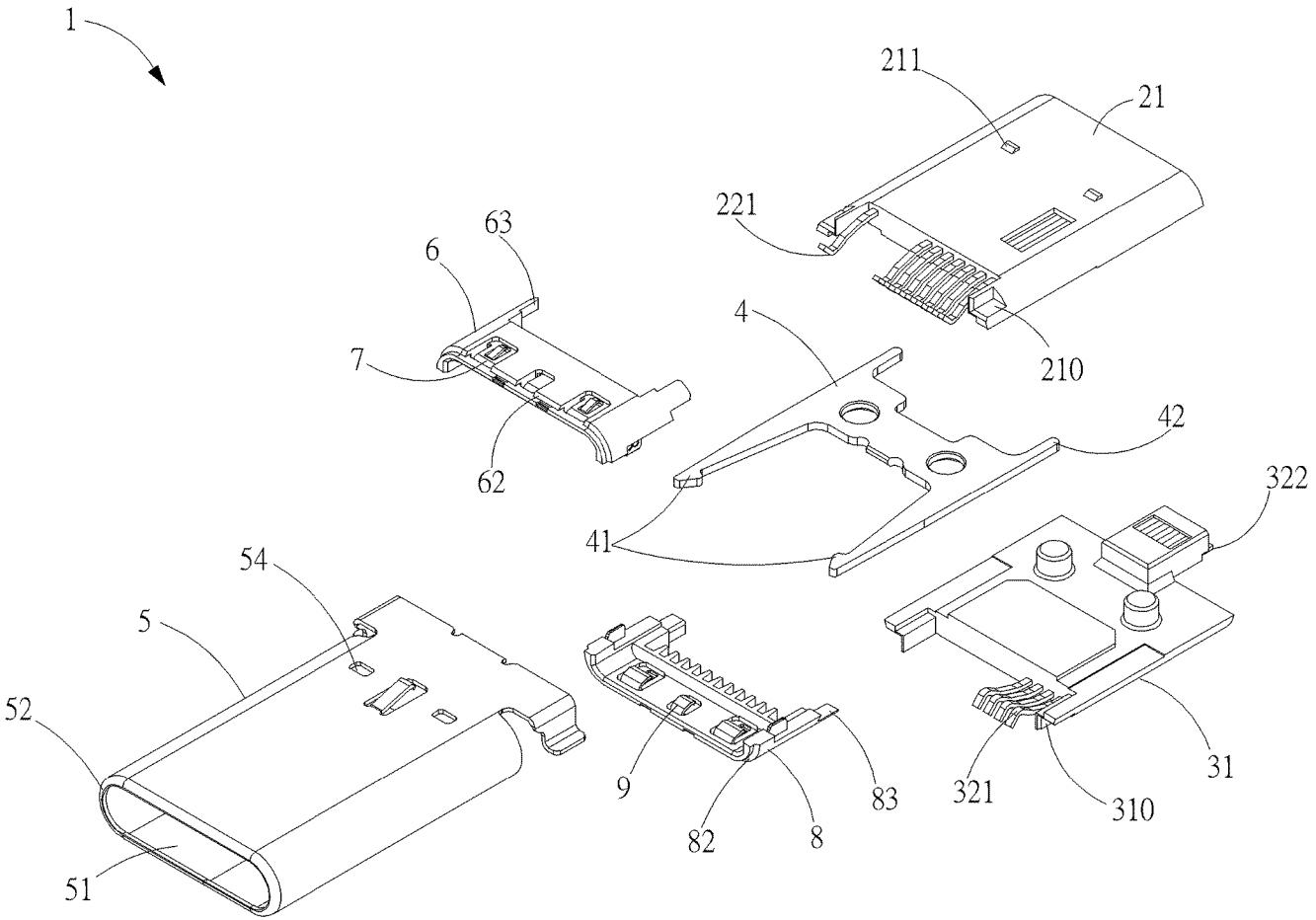
FIG. 5 is an exploded diagram of the connector structure as shown in FIG. 1 according to the embodiment of the present invention.
Figure 6:
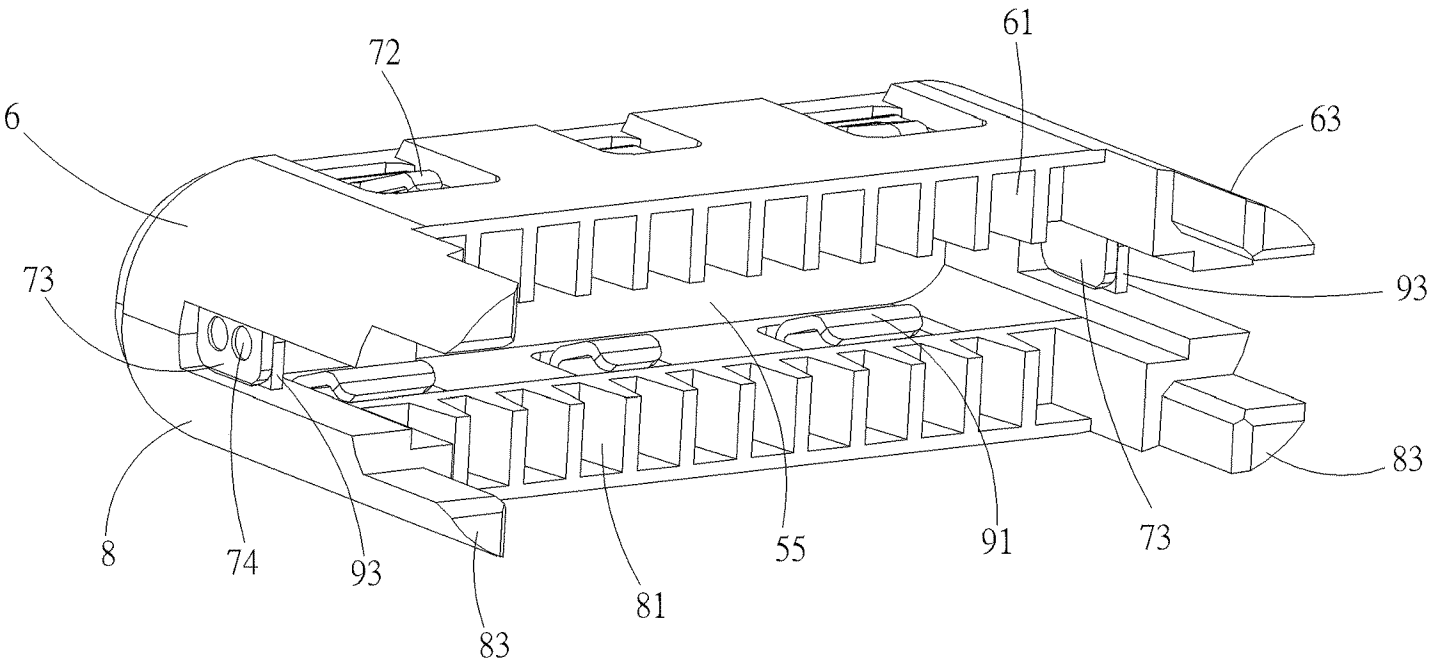
FIG. 6 is a schematic diagram of combination of an upper insulating component and a lower insulating component as shown in FIG. 4 according to the embodiment of the present invention.
Figure 7:
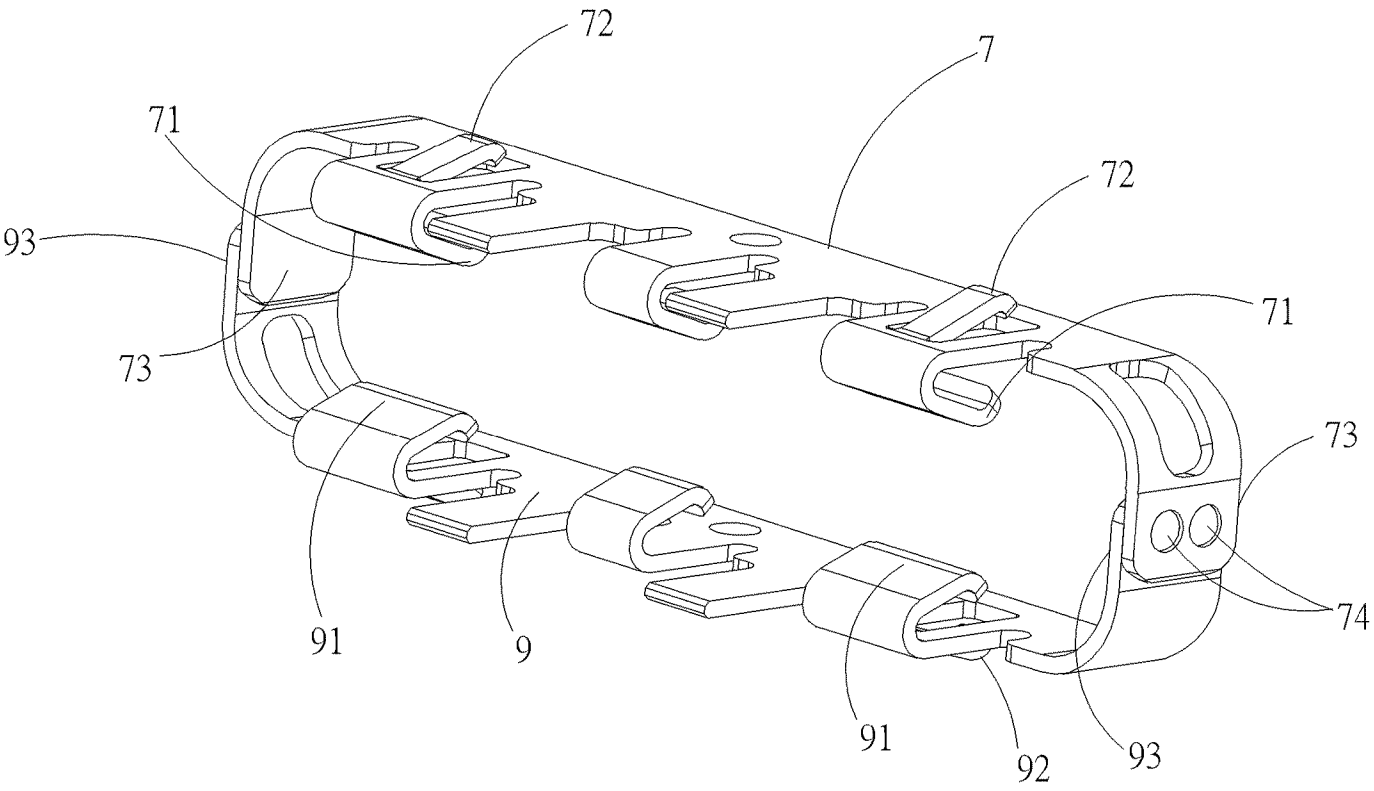
FIG. 7 is a schematic diagram of an upper grounding component and a lower grounding component as shown in FIG. 6 according to the embodiment of the present invention.
Figure 8:
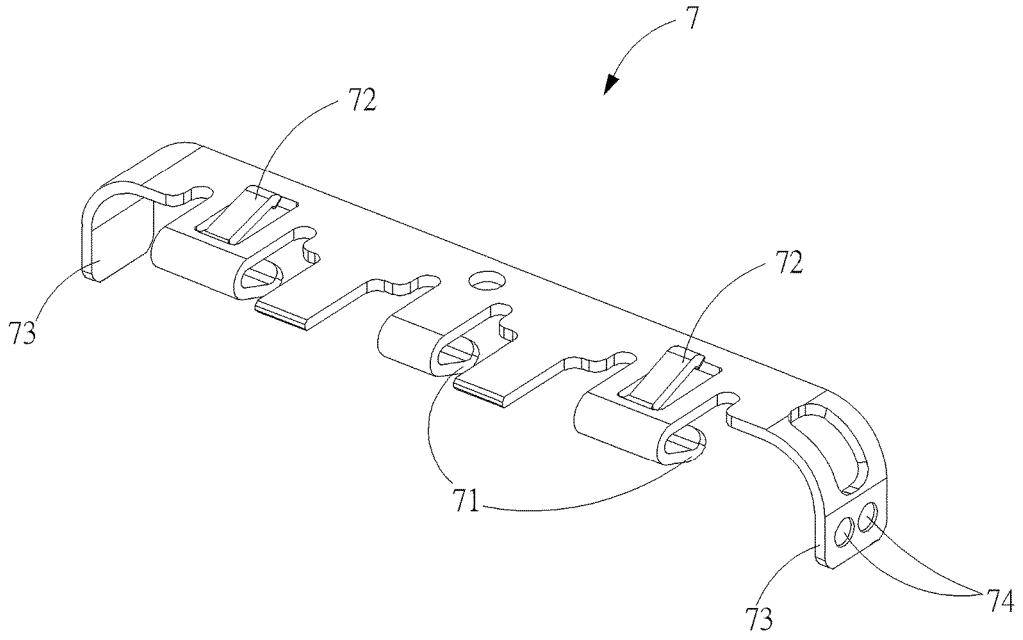
FIG. 8 is a schematic diagram of the upper grounding component as shown in FIG. 7 according to the embodiment of the present invention.

Please refer to FIG. 1 to FIG. 8. FIG. 1 is a schematic diagram of a connector structure 1 according to an embodiment of the present invention. FIG. 2 is a sectional diagram of the connector structure 1 according to the embodiment of the present invention. FIG. 3 is a schematic diagram of the connector structure 1 with a disassembled metal housing 5 according to the embodiment of the present invention. FIG. 4 is a partial exploded diagram of the connector structure 1 as shown in FIG. 1 according to the embodiment of the present invention. FIG. 5 is an exploded diagram of the connector structure 1 as shown in FIG. 1 according to the embodiment of the present invention. FIG. 6 is a schematic diagram of combination of an upper insulating component 6 and a lower insulating component 8 as shown in FIG. 4 according to the embodiment of the present invention. FIG. 7 is a schematic diagram of an upper grounding component 7 and a lower grounding component 9 as shown in FIG. 6 according to the embodiment of the present invention. FIG. 8 is a schematic diagram of the upper grounding component 7 as shown in FIG. 7 according to the embodiment of the present invention. The connector structure 1 includes an upper connecting component 2, a lower connecting component 3, a shielding plate 4, the metal housing 5, the upper insulating component 6, the upper grounding component 7, the lower insulating component 8 and the lower grounding component 9. The connector structure 1 can be welded on a circuit board (not shown in figures).

The upper connecting component 2 includes an upper main body 21 and a plurality of upper terminals 22 disposed on and extending out of the upper main body 21. The lower connecting component 3 includes a lower main body 31 and a plurality of lower terminals 32 disposed on and extending out of the lower main body 31. The upper connecting component 2 and the lower connecting component 3 are disposed opposite to each other. The upper main body 21 includes an upper positioning portion 210, and the lower main body 31 includes a lower positioning portion 310. In this embodiment, the plurality of upper terminals 22 can be fixed on the upper main body 21 by insert molding, and the plurality of lower terminals 32 also can be fixed on the lower main body 31 by insert molding. Each upper terminal 22 includes an upper contacting portion 221 and an upper welding portion 222, and the upper contacting portion 221 and the upper welding portion 222 extend out of the upper main body 21 along forward and backward directions respectively. Each lower terminal 32 includes a lower contacting portion 321 and a lower welding portion 322, and the lower contacting portion 321 and the lower welding portion 322 extend out of the lower main body 31 along forward and backward directions respectively. The upper main body 21 holds and aligns the plurality of upper terminals 22 along an interval direction perpendicular to a docking direction which the connector structure 1 docks with another docking connector, and the lower main body 31 holds and aligns the plurality of lower terminals 32 along the interval direction perpendicular to the docking direction.

The shielding plate 4 is disposed between the upper connecting component 2 and the lower connecting component 3, and the upper main body 21 and the lower main body 31 are disposed on an upper side and a lower side of the shielding plate 4 respectively, so that the shielding plate 4 can enhance stability of high frequency signal transmission of the plurality of upper terminals 22 and the plurality of lower terminals 32. A fixing structure can be formed between the upper connecting component 2 and the lower connecting component 3, as shown in FIG. 2, for fixing the shielding plate 4 between the upper main body 21 and the lower main body 31 so as to facilitate assembly. Besides, the shielding plate 4 includes a pair of locking portions 41 for locking another docking connector (not shown in figures), and the shielding plate 4 further includes a pair of grounding portions 42 electrically connected to a circuit board (not shown in figures) for grounding purpose.

The metal housing 5 covers the upper connecting component 2, the shielding plate 4 and the lower connecting component 3, so as to form a docking space 50. The metal housing 5 also covers the upper main body 21, the shielding plate 4 and the lower main body 31. The metal housing 5 further covers around the plurality of upper terminals 22 extending out of the upper main body 21 and the plurality of lower terminals 32 extending out of the lower main body 31 to form the docking space 50. A docking opening 51 is formed on a side of the docking space 50, and the metal housing 5 includes a stopping portion 52 disposed around the docking opening 51. In this embodiment, the stopping portion 52 can be an annular metal frame with an R angle and integrally formed with the metal housing 5 around the docking opening 51. An assembling opening 53 is formed on another side of the docking space 50 opposite to the docking opening 51. The metal housing 5 includes two engaging portions 54 disposed nearby the assembling opening 53. The upper main body 21 includes two fastening portions 211 located in positions corresponding to the two engaging portions 54 and for engaging with the two engaging portions 54 respectively. The engaging portions 54 and the fastening portions 211 can be slots and protrusions, respectively. Alternatively, the engaging portions 54 and the fastening portions 211 also can be protrusions and slots, respectively. Similarly, the lower main body 31 can be fastened with the metal housing 5 via the above-mentioned structure, so that the upper connecting component 2 and the lower connecting component 3 can be assembled inside the metal housing 5 via the assembling opening 53.

The upper insulating component 6 is disposed in the docking space 50 and restrained between the stopping portion 52 and the upper main body 21. The upper grounding component 7 is disposed on the upper insulating component 6. The lower insulating component 8 is disposed in the docking space 50 and restrained between the stopping portion 52 and the lower main body 31. The lower grounding component 9 is disposed on the lower insulating component 8. The upper insulating component 6 and the lower insulating component 8 are disposed opposite to each other, and a channel 55 is formed between the upper insulating component 6 and the lower insulating component 8. The channel 55 is communicated with the docking opening 51, and the plurality of upper terminals 22 and the plurality of lower terminals 32 extend into the channel 55. In this embodiment, a plurality of upper slots 61 are formed on the upper insulating component 6, a plurality of lower slots 81 are formed on the lower insulating component 8, and the plurality of upper slots 61 and the plurality of lower slots 81 are disposed opposite to each other and communicated with the channel 55 and located on an upper side and a lower side of the channel 55 respectively. A front end of each of the plurality of upper terminals 22 extends to the corresponding upper slot 61, and a front end of each of the plurality of lower terminals 32 extends to the corresponding lower slot 81. Therefore, the plurality of upper slots 61 and the plurality of lower slots 81 can protect front ends of the plurality of upper terminals 22 and front ends of the plurality of lower terminals 32, respectively.

In this embodiment, the upper insulating component 6 includes an upper front restraining portion 62 and an upper rear restraining portion 63, and the lower insulating component 8 includes a lower front restraining portion 82 and a lower rear restraining portion 83. The upper main body 21 includes an upper positioning portion 210, and the lower main body 31 includes a lower positioning portion 310. The upper front restraining portion 62 is restrained by the stopping portion 52, and the upper rear restraining portion 63 is restrained by the upper positioning portion 210. The lower front restraining portion 82 is restrained by the stopping portion 52, and the lower rear restraining portion 83 is restrained by the lower positioning portion 310. By the aforementioned structural design, it can decide a relative distance between the upper contacting portion 221 and the docking opening 51, a relative distance between the lower contacting portion 321 and the docking opening 51 and a relative distance between the upper contacting portion 221 and the lower contacting portion 321, so that the upper insulating component 6 and the lower insulating component 8 can have a positioning function. In this embodiment, the upper front restraining portion 62 and the lower front restraining portion 82 can be inclined plane structures formed on front edges of the upper insulating component 6 and the lower insulating component 8, respectively. The stopping portion 52 can be an annular metal frame with an R angle, and the inclined plane structures can be located in positions corresponding to the annular metal frame with the R angle, so as to achieve a constraining effect. The stopping portion 52 with the R angle also provides a protecting function, besides constraining the upper insulating component 6 and the lower insulating component 8.

Preferably, the upper rear restraining portion 63 includes two upper ribs disposed opposite to each other and extending from the upper insulating component 6. The upper positioning portion 210 includes two upper sunken portions disposed opposite to each other, and the two upper ribs can insert into the two upper sunken portions so as to provide a constraining effect. Similarly, the lower rear restraining portion 83 includes two lower ribs disposed opposite to each other and extending from the lower insulating component 8. The lower positioning portion 310 includes two lower sunken portions disposed opposite to each other, and the two lower ribs can insert into the two lower sunken portions so as to provide a constraining effect. By the aforementioned structural design, the upper insulating component 6 and the lower insulating component 8 can effectively position the upper main body 21 and the lower main body 31, respectively. Alternatively, the upper rear restraining portion 63 can include two upper sunken portions, and the upper positioning portion 210 can include two upper ribs. The lower rear restraining portion 83 can include two lower sunken portions, and the lower positioning portion 310 can include two lower ribs. The structural design for combining the upper insulating component 6 with the upper main body 21 and for combining the lower insulating component 8 with the lower main body 31 shall fall within the scope of the present invention.

It should be noticed that there are only the upper rear restraining portion 63 of the upper insulating component 6 and the lower rear restraining portion 83 of the lower insulating component 8 engaging with the upper positioning portion 210 of the upper main body 21 and the lower positioning portion 310 of the lower main body 31, respectively, as shown in FIG. 3 and FIG. 4 in this embodiment. There is no other portion of the upper insulating component 6 and the lower insulating component 8 covering, encircling or engaging with the upper main body 21 and the lower main body 31, so as to facilitate the assembly process and solve the conventional problem of low assembly yield. Furthermore, the channel 55 formed between the upper insulating component 6 and the lower insulating component 8 can accommodate front ends of the plurality of upper terminals 22 and the plurality of lower terminals 32, and the upper insulating component 6 and the lower insulating component 8 also can protect the plurality of upper terminals 22 and the plurality of lower terminals 32.

In this embodiment, for preventing electromagnetic interference (EMI), the upper grounding component 7 and the lower grounding component 9 are disposed on the upper insulating component 6 and the lower insulating component 8, respectively. The upper grounding component 7 includes a plurality of upper metal resilient clips 71 and a plurality of upper bridging portions 72, and the lower grounding component 9 includes a plurality of lower metal resilient clips 91 and a plurality of lower bridging portions 92. The upper metal resilient clip 71 and the lower metal resilient clip 91 extend into the channel 55, and the upper bridging portion 72 and the lower bridging portion 92 electrically contact with the metal housing 5. The upper grounding component 7 further includes two upper jointing sections 73 at two lateral sides, and the lower grounding component 9 further includes two lower jointing sections 93 at two lateral sides. The upper jointing sections 73 and the lower jointing sections 93 electrically contact with each other for an enhanced grounding effect.

For facilitating assembly, the upper insulating component 6 and the lower insulating component 8 can be combined together in advance and then sheathed into the metal housing 5. The upper jointing section 73 and the lower jointing section 93 can be fixed at welding points 74 by a laser welding manner, so as to fix the upper insulating component 6 and the lower insulating component 8, but it is not limited thereto. For example, the upper jointing section 73 and the lower jointing section 93 also can be fixed by structural interference. Alternatively, the upper insulating component 6 and the lower insulating component 8 also can be fixed by additional engaging structures without utilizing engagement of the upper jointing section 73 and the lower jointing section 93, but it is not limited thereto. For example, the upper insulating component 6 and the lower insulating component 8 also can be fixed in an adhering manner or a hot pressing manner.

In this embodiment, the upper insulating component 6 and the lower insulating component 8 can be same structures formed by plastic injection molding, so that it only needs to develop one set of mold to manufacture the upper insulating component 6 and the lower insulating component 8 simultaneously, which reduces manufacturing cost. Similarly, the upper grounding component 7 and the lower grounding component 9 can be same structures formed by metal stamping, so that it only needs to develop one set of mold to manufacture the upper grounding component 7 and the lower grounding component 9 simultaneously, which reduces manufacturing cost. Besides, the upper grounding component 7 and the lower grounding component 9 can be disposed on the upper insulating component 6 and the lower insulating component 8 by insert molding respectively, so as to reduce assembly steps and manufacturing cost.

In contrast to the prior art, the connector structure of the present invention utilizes the upper insulating component and the lower insulating component to replace a conventional holding member and further utilizes the stopping portion of the metal housing to replace a conventional protecting member, so as to increase the assembly yield and reduce components of the connector structure. It can effectively solve problems of low assembly yield and high manufacturing cost of the conventional connector, so as to meet requirements of low cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector structure comprising:

an upper connecting component comprising an upper main body and a plurality of upper terminals disposed on and extending out of the upper main body;

a lower connecting component comprising a lower main body and a plurality of lower terminals disposed on and extending out of the lower main body, the upper connecting component and the lower connecting component being disposed opposite to each other;

a shielding plate disposed between the upper connecting component and the lower connecting component, the upper main body and the lower main body being disposed on an upper side and a lower side of the shielding plate respectively;

a metal housing covering the upper main body, the shielding plate and the lower main body, the metal housing further covering around the plurality of upper terminals and the plurality of lower terminals to form a docking space, a docking opening being formed on a side of the docking space, the metal housing comprising a stopping portion disposed around the docking opening;

an upper insulating component disposed in the docking space and restrained between the stopping portion and the upper main body;

an upper grounding component disposed on the upper insulating component;

a lower insulating component disposed in the docking space and restrained between the stopping portion and the lower main body, the upper insulating component and the lower insulating component being disposed opposite to each other, a channel being formed between the upper insulating component and the lower insulating component, the channel being communicated with the docking opening, and the plurality of upper terminals and the plurality of lower terminals extending into the channel; and a lower grounding component disposed on the lower insulating component.

2. The connector structure of claim 1, wherein the upper insulating component comprises an upper front restraining portion and an upper rear restraining portion, the lower insulating component comprises a lower front restraining portion and a lower rear restraining portion, the upper main body comprises an upper positioning portion, the lower main body comprises a lower positioning portion, the upper front restraining portion is restrained by the stopping portion, the upper rear restraining portion is restrained by the upper positioning portion, the lower front restraining portion is restrained by the stopping portion, and the lower rear restraining portion is restrained by the lower positioning portion.

3. The connector structure of claim 2, wherein the upper grounding component comprises at least one upper metal resilient clip and at least one upper bridging portion, the lower grounding component comprises at least one lower metal resilient clip and at least one lower bridging portion, the at least one upper metal resilient clip and the at least one lower metal resilient clip extend into the channel, and the at least one upper bridging portion and the at least one lower bridging portion electrically contact with the metal housing.

4. The connector structure of claim 3, wherein the upper grounding component further comprises an upper jointing section, the lower grounding component further comprises a lower jointing section, and the upper jointing section and the lower jointing section electrically contact with each other.

5. The connector structure of claim 4, wherein the upper jointing section and the lower jointing section are fixed by a laser welding manner.

6. The connector structure of claim 2, wherein a plurality of upper slots are formed on the upper insulating component, a plurality of lower slots are formed on the lower insulating component, the plurality of upper slots and the plurality of lower slots are disposed opposite to each other and communicated with the channel and located on an upper side and a lower side of the channel respectively, a front end of each of the plurality of upper terminals extends to the corresponding upper slot, and a front end of each of the plurality of lower terminals extends to the corresponding lower slot.

7. The connector structure of claim 2, wherein the stopping portion is an annular metal frame with an R angle and integrally formed with the metal housing around the docking opening.

8. The connector structure of claim 7, wherein the upper front restraining portion and the lower front restraining portion are inclined plane structures formed on front edges of the upper insulating component and the lower insulating component, respectively.

9. The connector structure of claim 2, wherein the upper front restraining portion and the lower front restraining portion are inclined plane structures formed on front edges of the upper insulating component and the lower insulating component, respectively.

10. The connector structure of claim 2, wherein the upper rear restraining portion comprises two upper ribs disposed opposite to each other and extending from the upper insulating component, the upper positioning portion comprises two upper sunken portions disposed opposite to each other, and the two upper ribs insert into the two upper sunken portions so as to provide a constraining effect.

11. The connector structure of claim 1, wherein the upper insulating component and the lower insulating component are same structures formed by plastic injection molding, and the upper grounding component and the lower grounding component are same structures formed by metal stamping.

12. The connector structure of claim 11, wherein the upper grounding component and the lower grounding component are disposed on the upper insulating component and the lower insulating component by insert molding, respectively.

13. The connector structure of claim 1, wherein the upper grounding component and the lower grounding component are disposed on the upper insulating component and the lower insulating component by insert molding, respectively.

14. The connector structure of claim 1, wherein an assembling opening is formed on another side of the docking space opposite to the docking opening, and the upper connecting component and the lower connecting component are assembled inside the metal housing via the assembling opening.

15. The connector structure of claim 14, wherein the metal housing comprises two engaging portions disposed nearby the assembling opening, and the upper main body comprises two fastening portions located in positions corresponding to the two engaging portions and for engaging with the two engaging portions respectively.

16. The connector structure of claim 15, wherein the engaging portions and the fastening portions are slots and protrusions, respectively.

* * * * *